US009759511B2

(12) United States Patent
McKinney

(10) Patent No.: US 9,759,511 B2
(45) Date of Patent: Sep. 12, 2017

(54) BOW PRESS

(71) Applicant: Last Chance Archery LLC, Pendergrass, GA (US)

(72) Inventor: Glen L. McKinney, Erda, UT (US)

(73) Assignee: LAST CHANCE ARCHERY LLC, Pendergrass, GA (US)

( * ) Notice: Subject to any disclaimer, the term of this patent is extended or adjusted under 35 U.S.C. 154(b) by 0 days.

(21) Appl. No.: 15/248,186

(22) Filed: Aug. 26, 2016

(65) Prior Publication Data

US 2017/0067713 A1 Mar. 9, 2017

Related U.S. Application Data

(60) Provisional application No. 62/214,407, filed on Sep. 4, 2015.

(51) Int. Cl.
*F41B 5/14* (2006.01)

(52) U.S. Cl.
CPC ..... *F41B 5/1449* (2013.01)

(58) Field of Classification Search
CPC ..... F41B 5/1449
See application file for complete search history.

(56) References Cited

U.S. PATENT DOCUMENTS

| | | | |
|---|---|---|---|
| 97,872 | A | 12/1869 | Burkhardt |
| 323,955 | A | 8/1885 | Patten |
| 922,336 | A | 5/1909 | Rivers |
| 3,055,655 | A | 9/1962 | Chelf |
| 3,580,459 | A | 5/1971 | Gage et al. |
| 4,415,149 | A | 11/1983 | Rees |
| 5,022,377 | A | 6/1991 | Stevens |
| 5,222,473 | A | 6/1993 | Lint |
| 5,370,103 | A | 12/1994 | Desselle |
| 5,425,350 | A | 6/1995 | Egusquiza |
| 5,433,186 | A | 7/1995 | Corwin |
| 5,746,192 | A | 5/1998 | Gissel |
| 6,386,190 | B1 | 5/2002 | Kurtz, Jr. |

(Continued)

OTHER PUBLICATIONS

Office Action in U.S. Appl. No. 11/532,615, dated Oct. 8, 2008, 7 pages (pp. 1-7 in pdf).

(Continued)

*Primary Examiner* — John Ricci
(74) *Attorney, Agent, or Firm* — Mitch Harris, Atty at Law, LLC; Andrew M. Harris

(57) ABSTRACT

An archery bow press includes a base frame, and first and second support assemblies mounted to the base frame. The support assemblies each a support member mounted to the base frame, a first limb support having first and second end portions and being mounted to the support member at a location spaced between the first and second end portions, a second limb support pivotally mounted to the first end portion of the first limb support, a contact member mounted to the second end portion of the first limb support. The second limb support is configured to contact a distal end of a bow limb of an archery bow that is mounted to the archery bow press. The contact member is configured to contact the bow limb at a location spaced proximal of the distal end and proximal of a bend point in the bow limb when the bow limb is flexed.

19 Claims, 11 Drawing Sheets

(56) References Cited

U.S. PATENT DOCUMENTS

| | | | | |
|---|---|---|---|---|
| 6,932,070 | B1 | 8/2005 | Kurtz, Jr. | |
| 6,957,647 | B2 | 10/2005 | Evans et al. | |
| 6,968,834 | B1 | 11/2005 | Gibbs | |
| 7,089,923 | B2 | 8/2006 | Johnson | |
| 7,185,644 | B2 | 3/2007 | Kurtz, Jr. | |
| 7,255,099 | B2 | 8/2007 | Henry | |
| 7,597,094 | B2 | 10/2009 | Pittman | |
| 7,644,708 | B2 | 1/2010 | Pittman | |
| 9,255,760 | B2 * | 2/2016 | Tulpa | F41B 5/1449 |

OTHER PUBLICATIONS

Final Office Action in U.S. Appl. No. 11/532,615, dated Jan. 22, 2009, 4 pages (pp. 1-4 in pdf).
Office Action in U.S. Appl. No. 11/532,615, dated Feb. 27, 2009, 6 pages (pp. 1-6 in pdf).
Office Action in U.S. Appl. No. 11/532,615, dated May 26, 2009, 6 pages (pp. 1-6 in pdf).
Notice of Allowance in U.S. Appl. No. 11/532,615 dated Aug. 20, 2009, 7 pages (pp. 1-7 in pdf).
Office Action in U.S. Appl. No. 12/346,364 dated Aug. 4, 2009, 7 pages (pp. 1-7 in pdf).
Notice of Allowance in U.S. Appl. No. 12/346,364 dated Nov. 16, 2009, 4 pages (pp. 1-4 in pdf).

* cited by examiner

BOW PRESS

TECHNICAL FIELD

The present disclosure generally relates to bow presses for archery bows.

BACKGROUND

Bow presses are used to flex the limbs of archery bows so that the cables and/or bowstrings of the bow may be installed, repaired, or otherwise serviced when not in tension. The force required to flex the bow limbs in order to remove the bowstring and/or cables and perform other operations can require hundreds of pounds of force.

A typical shop bow press is stabilized at multiple points along the curvature of the bow (e.g., along the limbs of the bow). The force applied to compress the limbs of the bow is often applied by a crank along the direction of the arrow flight, which is perpendicular to the radius of curvature of the bow. The press is often located outside of the curvature of the bow limbs, so that the structure of the bow press impedes access to the bowstring, cables and other components. Most bow presses require training in order to properly compress bow limbs without damaging the riser or limbs.

Other bow presses, such as those intended for field include portable structure that contracts a bow using tension that is applied from the inside of the bow curvature, and often only from the ends of the bow limbs. These types of bow presses include tensioning features that are positioned in or near the path of the bowstring, cables and other components.

It is usually preferred to compress or flex the bow limbs by contacting the ends of the bow limbs. As such, the ends of the limbs must be able to tolerate a force along the direction of the bowstring at least equal to that applied by the bowstring(s) at the point of maximum draw, as that force is applied to the bow in use. Therefore, compound bows typically will be strong at the bow limb ends and tolerant of a force applied along the direction of the bowstring and cable at the bow limb ends, as that force is applied when the bowstring is drawn. Often, applying compression forces at only the ends of the bow limbs creates not only a horizontally applied force that compresses the bow, but also a vertical force that tends to urge the bow out of the bow press. These vertical forces may be especially prominent in scenarios where the limbs are compressed past a parallel arrangement in order to release the bowstring and/or cables. If the bow were to unintentionally release from the bow press during compression of the bow, those operating the press as well as surrounding equipment may be hurt or damaged.

There is therefore a need for improvements in bow presses to improve their efficiency, effectiveness, and ease of use.

SUMMARY

One aspect of the present disclosure relates to an archery bow press that includes a base frame and first and second support assemblies mounted to the base frame. The support assemblies each include a support member mounted to the base frame, a first limb support having first and second end portions and being mounted to the support member at a location spaced between the first and second end portions, a second limb support pivotally mounted to the first end portion of the first limb support, and a contact member mounted to the second end portion of the first limb support. The second limb support is configured to contact a distal end of a bow limb of an archery bow that is mounted to the archery bow press. The contact member is configured to contact the bow limb at a location spaced proximal of the distal end and proximal of a bend point in the bow limb when the bow limb is flexed.

The second limb support may include a first portion configured to extend along and contact an outer face of the bow limb, and a second portion configured to extend along and contact a distal end surface of the bow limb. The second limb support pivots relative to the first limb support and the base frame to maintain contact with the outer face of the bow limb as the archery bow is compressed between the first and second support assemblies. The contact member may include a roller that is able to move along the outer face of the bow limb as the archery bow is compressed. The base frame may include a horizontal member, at least two legs supporting the horizontal member, a telescoping member adjustably mounted to the horizontal member, and an actuator operable to move the telescoping member relative to the horizontal member. The first support assembly may be mounted to the horizontal member and the second support assembly may be mounted to the telescoping member, and operating the actuator may move the first and second support assemblies relative to each other to adjust a compression force applied to the archery bow.

The actuator may include a crank arm and a worm drive. The first limb support maintains a fixed position relative to the support member. The second limb support may include a pair of second limb support members laterally spaced apart from each other a distance that accommodates a pulley of the archery bow. The first and second support assemblies may be positioned laterally spaced apart from each other along a length of the base frame. The first limb support may include a curved shape along its length. The second limb support may have an L-shape construction.

Another aspect of the present disclosure relates to a method of compressing an archery bow with a bow press. The method includes providing a bow press having first and second bow support assemblies, each bow support assembly having first and second limb supports and a contact member. The second limb support is pivotally mounted to a first end portion of the first limb support, and the contact member is mounted to a second end portion of the first limb support. The method also includes mounting the archery bow to the bow press with distal ends and outer faces of limbs of the bow being positioned in contact with the second limb supports, and moving the first and second bow support assemblies toward each other to apply a compression force to the archery bow to bend the limbs until the contact members contact the limbs. The contact members contact the limbs at a location spaced proximal of the distal ends of the limbs and proximal of a bend region in the limbs when flexed, and the second limb supports rotate relative to the first limb supports to maintain contact with the distal ends and outer faces of the limbs while the limbs are being flexed.

According to this method, contact between the contact members and the limbs may provide application of a force component in a direction from the contact members toward the second limb supports. The force component may contribute to maintaining the archery bow mounted to the bow press. The contact members may move into and out of contact with the limbs as the compression force is applied to the archery bow. Moving the first and second bow support assemblies toward each other may include moving the first and second bow support assemblies laterally relative to each other. Moving the first and second bow support assemblies toward each other may change a direction of force vectors applied at an interface between the second limb supports and the limbs.

A further aspect of the present disclosure relates to an archery bow press that includes first and second support assemblies. Each of the support assemblies includes a first limb support having first and second end portions, a second limb support, and a contact member. The second limb support is pivotally mounted to the first end portion of the first limb support and configured to contact a distal end surface and an outer face of a bow limb of an archery bow that is mounted to the archery bow press. The contact member is mounted to the second end portion of the first limb support and is configured to contact the outer face of the bow limb at a location spaced proximal of the distal end surface and proximal of a bend section of the bow limb when flexed.

The second limb support may include a first portion configured to extend along and contact an outer face of the bow limb, and a second portion configure to extend along and contact a distal end surface of the bow limb. The second limb support may pivot relative to the first limb support and the base frame to maintain contact with the distal end surface and outer face of the bow limb as the archery bow is compressed between the first and second support assemblies.

The above summary of the present invention is not intended to describe each embodiment or every implementation of the present invention. The Figures and the detailed description that follow more particularly exemplify one or more preferred embodiments.

BRIEF DESCRIPTION OF THE DRAWINGS

The accompanying drawings and figures illustrate a number of exemplary embodiments and are part of the specification. Together with the present description, these drawings demonstrate and explain various principles of this disclosure. A further understanding of the nature and advantages of the present invention may be realized by reference to the following drawings. In the appended figures, similar components or features may have the same reference label.

Figure 1:
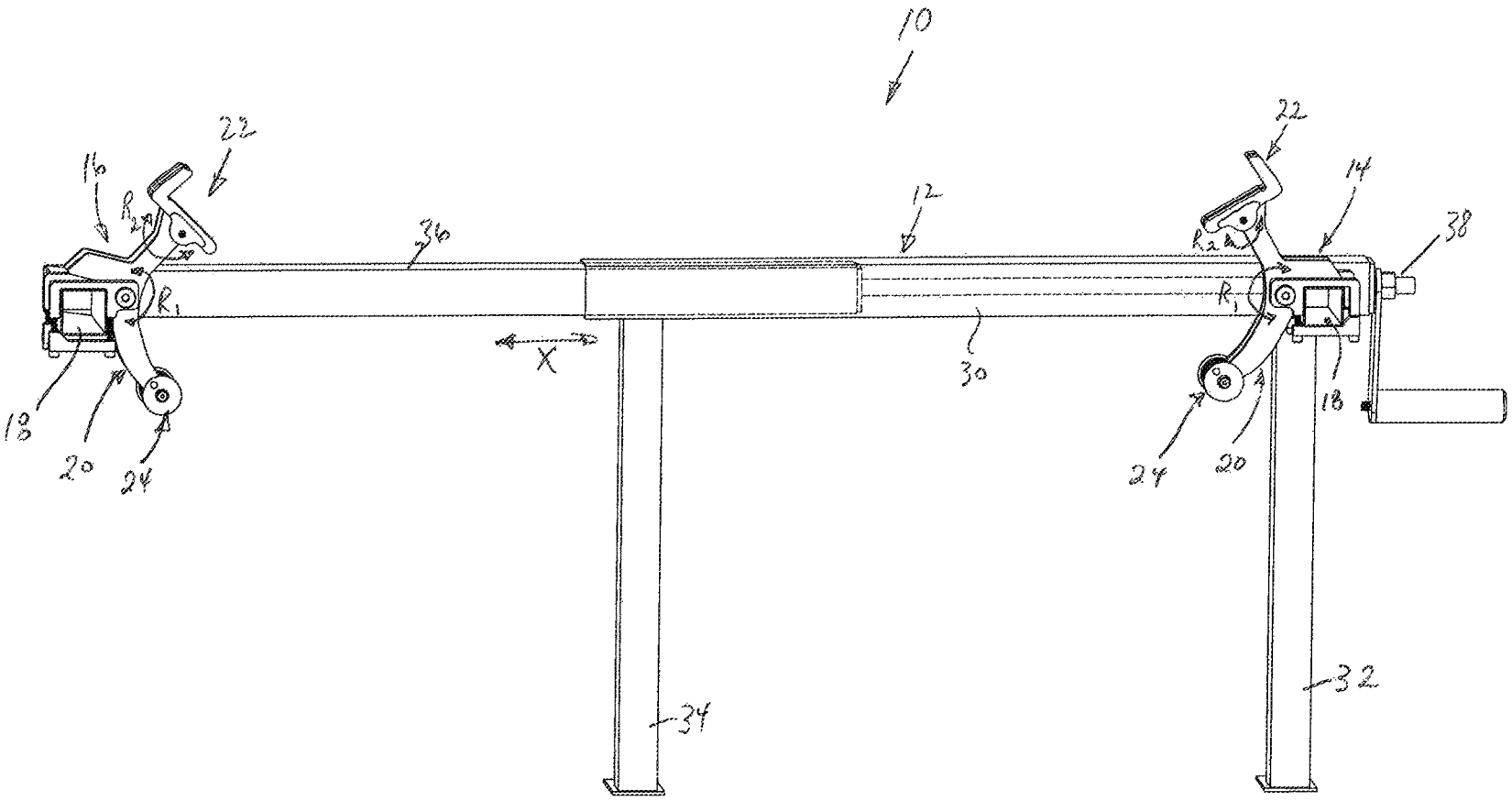
FIG. 1 is a perspective view of a bow press in accordance with the present disclosure.

While the embodiments described herein are susceptible to various modifications and alternative forms, specific embodiments have been shown by way of example in the drawings and will be described in detail herein. However, the exemplary embodiments described herein are not intended to be limited to the particular forms disclosed. Rather, the instant disclosure covers all modifications, equivalents, and alternatives falling within the scope of the appended claims.

DETAILED DESCRIPTION

The present disclosure generally relates to bow press devices and systems, and methods for compressing (e.g., pressing) an archery bow. A bow press may be used to compress the limbs of an archery bow to make it possible to install the bowstring and/or cables to the archery bow. A bow press may also be used to service an archery bow that has already been assembled with a bowstring and cables, such as, for example, to repair the bowstring or cables, or remove the bowstring and cables in order to replace other components such as the limbs or riser of the archery bow.

The bow press may include a pair of support assemblies that are arranged to contact separate limbs of the archery bow being compressed. The support assemblies are moved toward and away from each other as part of compressing an archery bow and/or releasing an archery bow from a compressed state. The support assemblies each include a first limb support that contacts both a distal end surface of the limb and an outer face of the limb adjacent to the distal end. The support assemblies also include a second limb support that is mounted to a first end of the second limb support, and a contact member that is mounted to an opposite, second end of the second limb support. The contact member contacts the limb of the archery bow at a location spaced proximal of the distal end of the limb. Typically, the contact member contacts the limb at a location that is proximal of a bend portion of the limb.

The bow press may operate to compress the archery bow such that the limbs move from an uncompressed state (i.e., a static state outside of the bow press where the limbs, the riser, the cables, and the bowstring are assembled together, with the bow being ready to use) extending at a positive angle relative to a vertical direction, to a fully compressed state where the limbs extend at a negative angle relative to the vertical direction. As the bow press applies a compression force to compress the archery bow, the first and second limb supports may automatically adjust to account for the change in curvature of the limbs as the limbs move between the positive and negative angled orientations relative to the vertical direction. This automated adjustment of the first and second limb supports alters the direction of the forces applied to the limb by the first limb support and the contact member to limit inadvertent release of the archery bow from the bow press. The archery bow may maintain connection to the bow press without the use of a positive connection features such as fasteners, clamps, or the like.

Referring now to FIGS. 1-7B, and particularly FIG. 1, an example archery bow press 10 is described in detail. Bow press 10 includes a base frame 12 and first and second support assemblies 14, 16. Base frame 12 is only one example of the many types of base frames that may be possible. The first and second support assemblies 14, 16 are mounted to the base frame 12 and may be moveable toward and away from each other by operation of the base frame 12 to compress an archery bow and/or release an archery bow from compression. The first and second support assemblies 14, 16 may include features that are substantially mirror images of each other when mounted to base frame 12. In some embodiments, at least some of the components of each of the support assemblies 14, 16 may be removed and/or replaced with other components to provide variation in operation of the bow press 10. At least some of the components of the first and second support assemblies 14, 16 may be used in other types of bow presses to provide at least some of the features and functionality described herein with respect to bow press 10.

The base frame 12 includes a horizontal member 30, a pair of legs 32, 34 supporting the horizontal member 30, a telescoping member 35 adjustably mounted to the horizontal member 30, and an actuator 38 that moves the telescoping member 36 relative to the horizontal member 30. The telescoping member 36 moves axially in a direction X relative to the horizontal member 30 by operation of the actuator 38. As shown in at least FIGS. 7A and 7B, the actuator 38 may include a crank 37 and worm drive 39 that provide the axial movement of the telescoping member 36 in the direction X. Other types of actuators are possible to move the telescoping member 36 relative to the horizontal member 30.

The telescoping member 36 may slide into the horizontal member 30. The horizontal member 30 and telescoping member 36 may include matching cross-sectional shapes (e.g., a rectangular cross-sectional shape). Rotating the crank 37 may rotate the worm drive 39 to move the telescoping member 36 into and out of the horizontal member 30 between the extended position shown in FIG. 7A and the retracted position shown in FIG. 7B.

Figure 2:
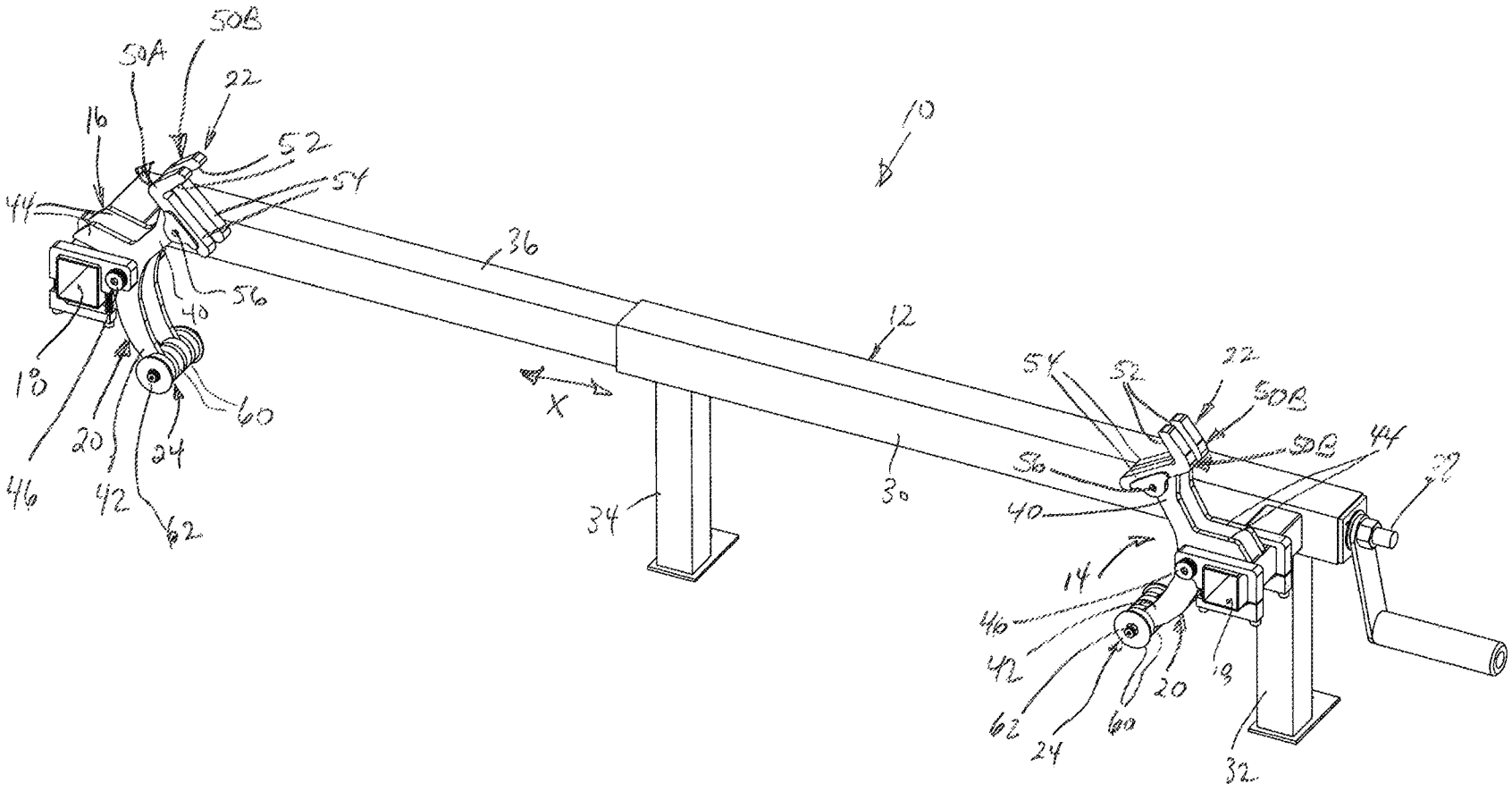
FIG. 2 is another perspective view of the bow press shown in FIG. 1.
Figures 3, 4:
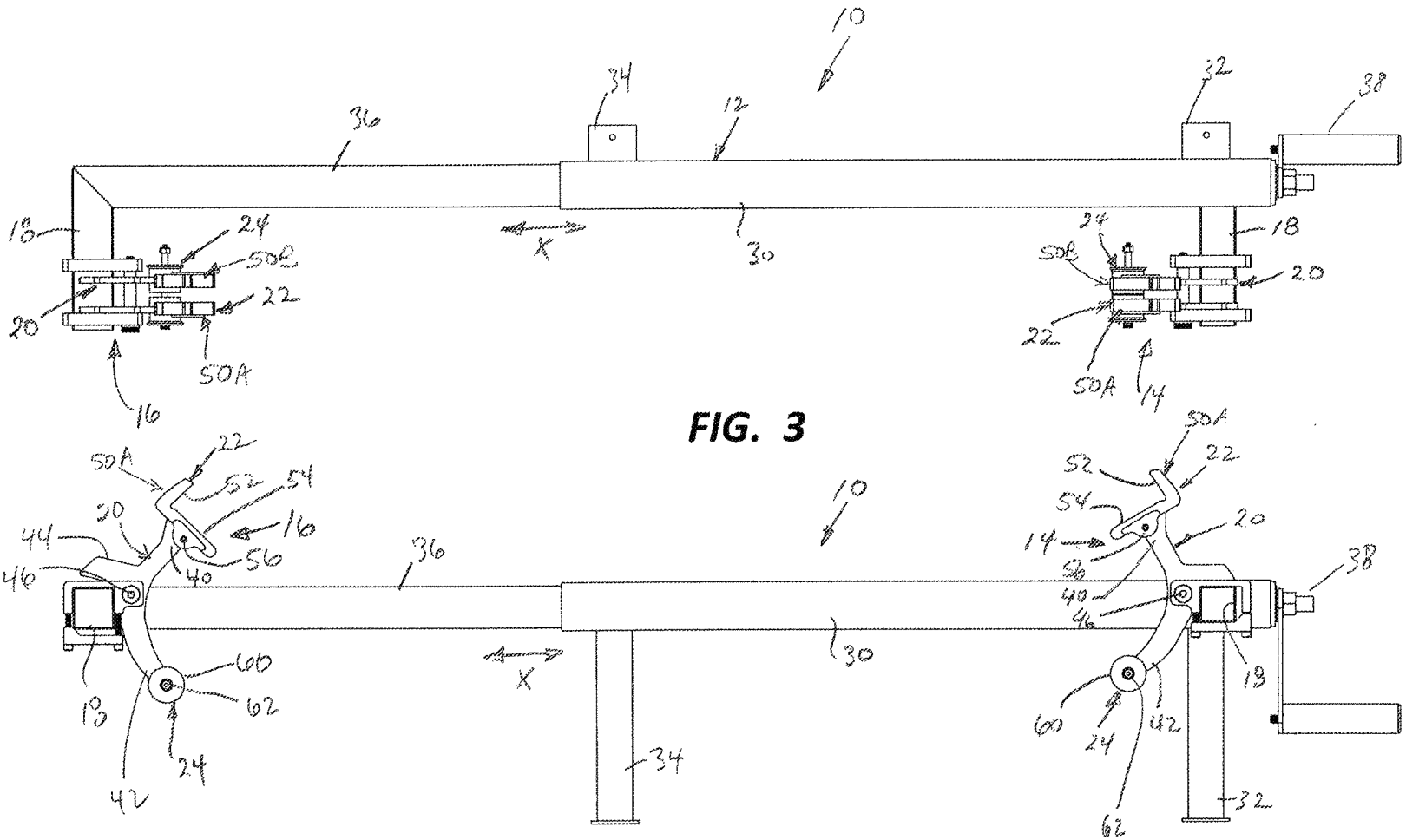
FIG. 3 is a top view of the bow press shown in FIG. 1.
FIG. 4 is a side view of the bow press shown in FIG. 1.

The first limb support 20 may include first and second ends 40, 42, a support bracket 44, and a mounting pin or axle 46, as shown in FIG. 2. The first limb support 20 may be pivotally mounted to the support member 18. The support member 18 is mounted to either the horizontal member 30 or the telescoping member 36 depending on the support assembly 14, 16. In at least some embodiments, the support member 18 may have a matching cross-sectional shape and size to the portion of the base frame 12 to which the support member 18 is mounted.

The support bracket 44 may provide a rotation position stop for the first limb support 20 relative to the support member 18. FIG. 2 shows the support bracket 44 associated with the first support assembly 14 rotated into contact with the support member 18, and the support bracket 44 associated with the second support assembly 16 rotated out of contact with the respective support member 18. The first limb support 20 may automatically rotate in the direction $R_1$ (see FIG. 1) relative to the support member 18 as the bow press 10 is operated to compress an archery bow and/or as the direction in which force is applied from the first and second support assemblies 14, 16 to the archery bow changes as the limbs flex.

Figure 6:
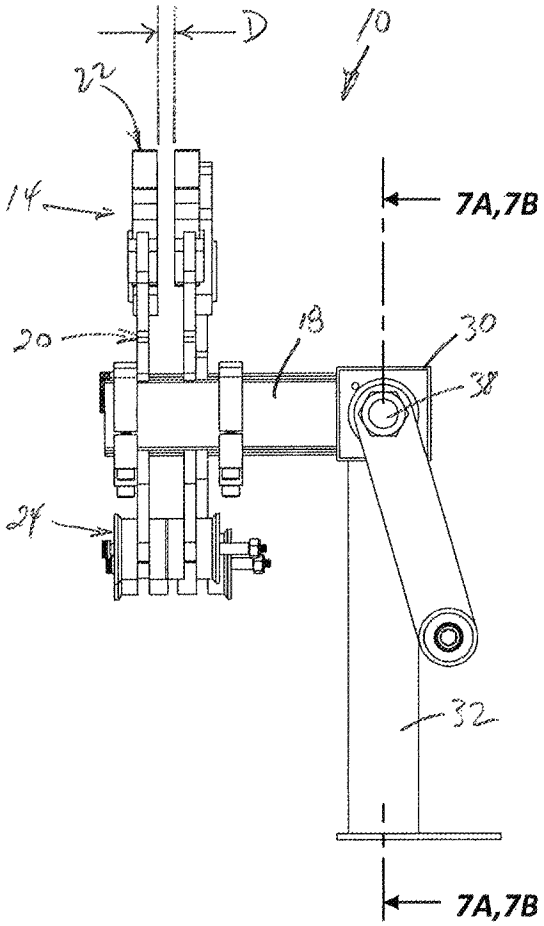
FIG. 6 is an opposite end view of the bow press shown in FIG. 1.
Figure 5:
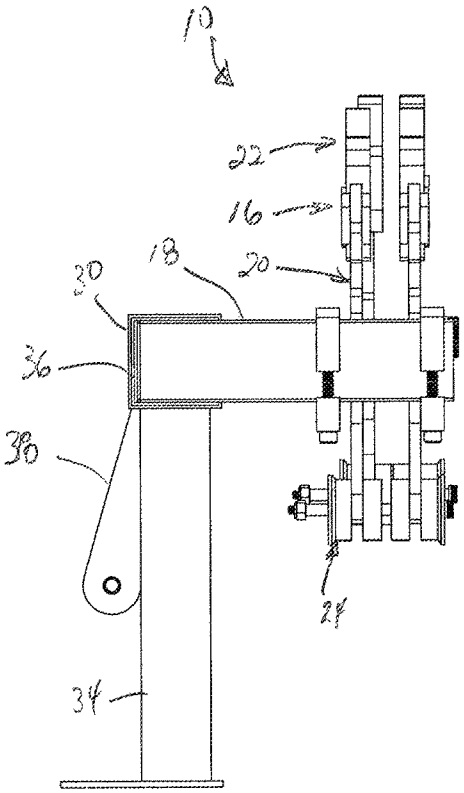
FIG. 5 is an end view of the bow press shown in FIG. 1.
Figure 7A:
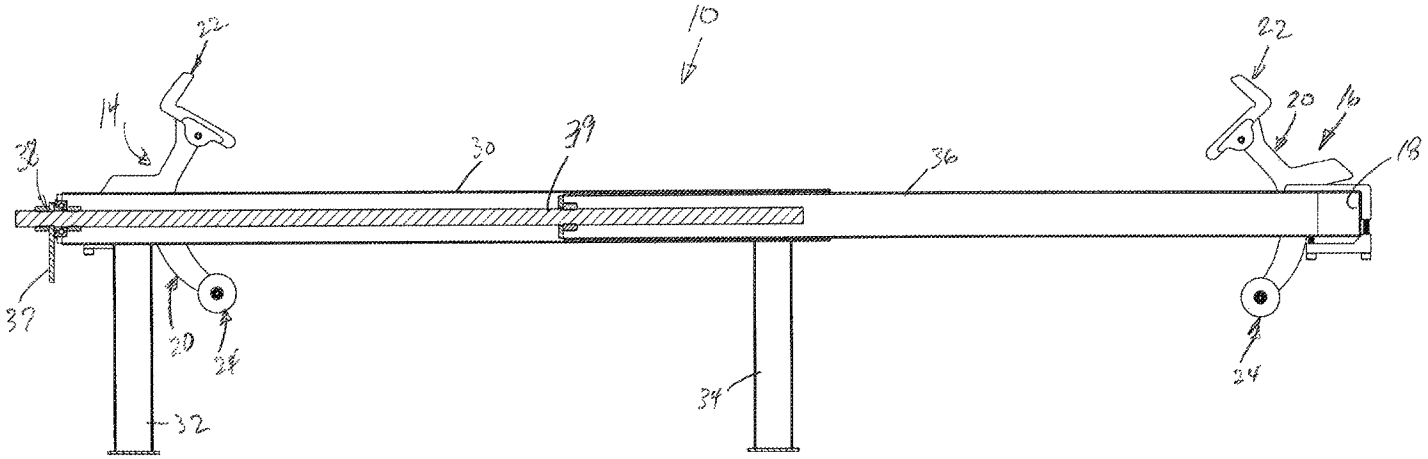
FIGS. 7A and 7B are cross-sectional views of the bow press shown in FIG. 6 taken along cross-section indicators 7A, 7B.
Figure 7B:
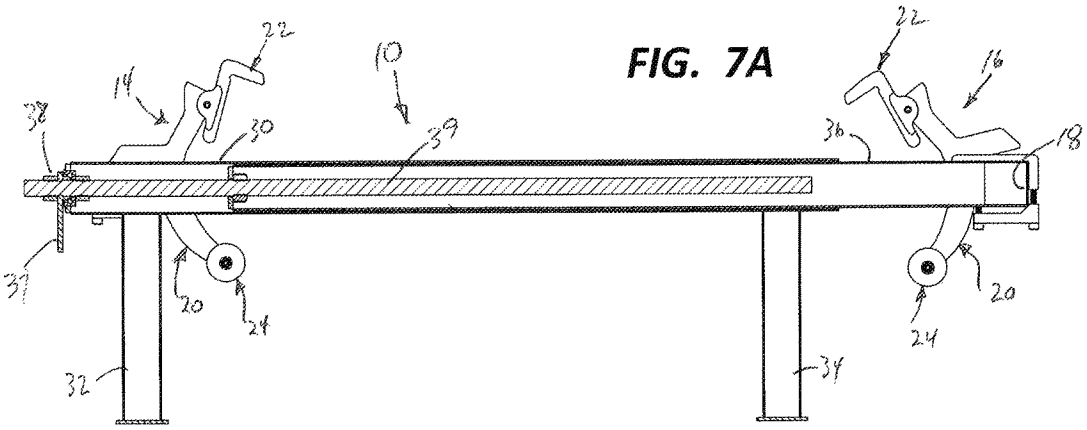

The second limb support 22 may include a pair of support portions 50A, 50B that each include first and second contact portions 52, 54, as shown in FIG. 2. The second limb support 22 is mounted to the first end 40 of the first limb support 20 with a mounting pin or axle 56. The second limb support 22 rotates about the mounting pin 56 a rotation direction $R_2$, as shown in FIG. 1. The support portions 50A, 50B may be spaced apart a distance D as shown in FIG. 6. The spacing D may accommodate a pulley of the archery bow when the archery bow is mounted to the bow press 10, as shown in FIGS. 8A-8D.

Referring again to FIG. 2, the first and second contact portions 52, 54 may be arranged at a right angle (e.g., perpendicular) relative to each other. The first and second contact portions 52, 54 may have an L-shaped construction. The first and second contact portions 52, 54 may be arranged relative to each other to accommodate any limb shape or size. The first contact portion 52 is arranged to contact a distal end surface of a limb of the archery bow as will be further described with reference to FIGS. 8A-8D. The second contact portion 54 may be arranged to contact an outer face of the archery bow limb as will be described in further detail with respect to FIGS. 8A-8D. Typically, both of the support portions 50A, 50B contact the respective archery bow limb at the same time. In at least some embodiments, it may be possible for only one of the support portions 50A, 50B to contact the respective limb at a given time. In some embodiments, the second limb support 22 may include more than two support portions 50A, 50B. In other embodiments, the second limb support 22 has a single-piece construction rather than having separate, individually rotatable support portions 50A, 50B.

The contact member 24 may be mounted to the second end 42 of the first limb support 20. The contact member 24 may include at least one roller 60. The contact member 24 may be mounted to the first limb support 20 with a mounting pin or axle 62, as shown in FIG. 2. The roller 60 may include a plurality of rollers that are spaced apart along the mounting pin 62. At least some of the rollers 60 may include a raised lip or guide rail feature that helps center the archery bow limb on the contact member 24.

Referring now to FIGS. 8A-8D, an example archery bow 70 is shown mounted to the bow press 10. Archery bow 70 includes a riser 72, first and second limbs 74, 76, a bowstring 78, cables 80, and first and second pulleys 82, 84. Each of the limbs 74, 76 may include a bend area or bend portion 75 (also referred to as a bend section or bend region), an outer face 77, and a distal end surface 79. The outer face 77 faces away from the riser and the oppositely positioned limb.

Figure 8A:
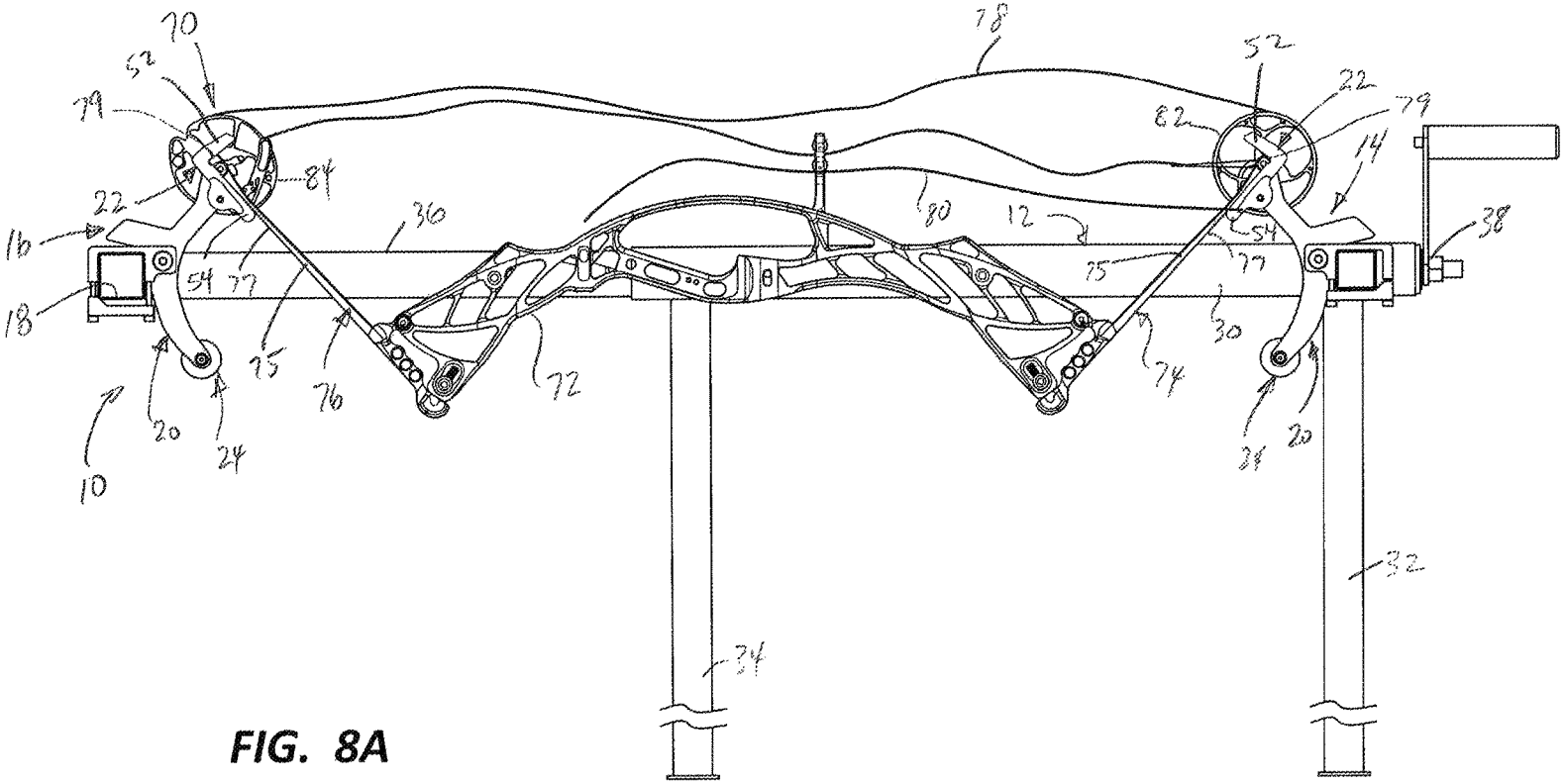
FIGS. 8A-8D are side views of the bow press shown in FIG. 1 showing different stages of compressing an archery bow.

When the archery bow 70 is mounted to the bow press 10 and in an uncompressed state as shown in FIG. 8A, the first and second limb 74, 76 are positioned in contact with the first and second contact portions 52, 54. The distal end surface 79 may be arranged in contact with the first contact portion 52, and the outer face 77 may be arranged in contact with the second contact portion 54. The second limb support 22 may automatically rotate into a position of least resistance relative to the first limb support 20, and the first limb support 20 may be rotated into a position of least resistance relative to the support member 18 when the archery bow is in the uncompressed state shown in FIG. 8A. As the bow press 10 operates to compress the archery bow 70, the first and second limb supports 20, 22 automatically rotate as needed to maintain contact between the first and second contact portions 52, 54 and the distal end surface 79 and outer face 77, respectively. The contact member 24 contacts the first and second limbs 74, 76 after the archery bow 70 is compressed a certain amount, as shown by the comparison of FIGS. 8A-8D.

Figure 9B:
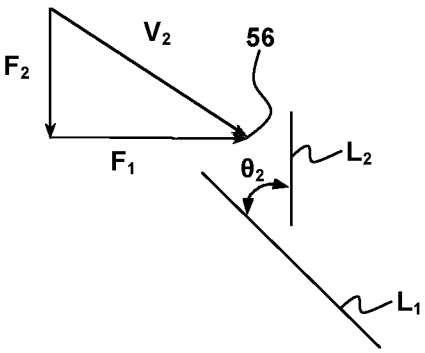
FIGS. 9A-9D show force vectors and angles associated with the stages of compressing the archery bow shown in FIGS. 8A-8D.
Figure 9A:
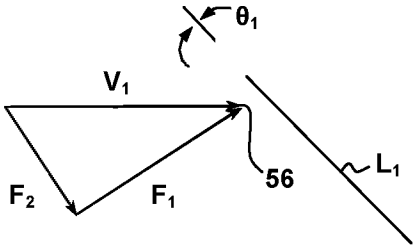

The compression force applied by operation of the bow press 10 is passed at least in part through the mounting pin 56 to the second limb support 22. The compression force includes force vectors $F_1$, $F_2$ in the normal direction and tangential direction, respectively, to the limb 74, 76. FIG. 9A shows the force vectors $F_1$, $F_2$ and the resulting net force vector $V_1$ applied at the mounting pin 56. The line labeled $L_1$ represents the orientation of the limbs 74, 76 when the archery bow 70 is in the uncompressed state shown in FIG. 8A. The angle θrepresents the angle of the distal end of the limbs 74, 76 at each compressed state of the archery bow 70 relative to the position of the distal end of the limbs 74, 76 when in the rest position shown in FIG. 8A. The angle $\theta_1$ shown in FIG. 9A is zero.

The arrangement of the distal ends of the limbs 74, 76 of the uncompressed archery bow shown in FIG. 8A may be considered a positive angle orientation relative to a vertical direction. As the archery bow 70 is compressed, the limbs 74, 76 move past the vertical direction to a negative angle orientation shown in FIGS. 8C and 8D.

Figure 8B:
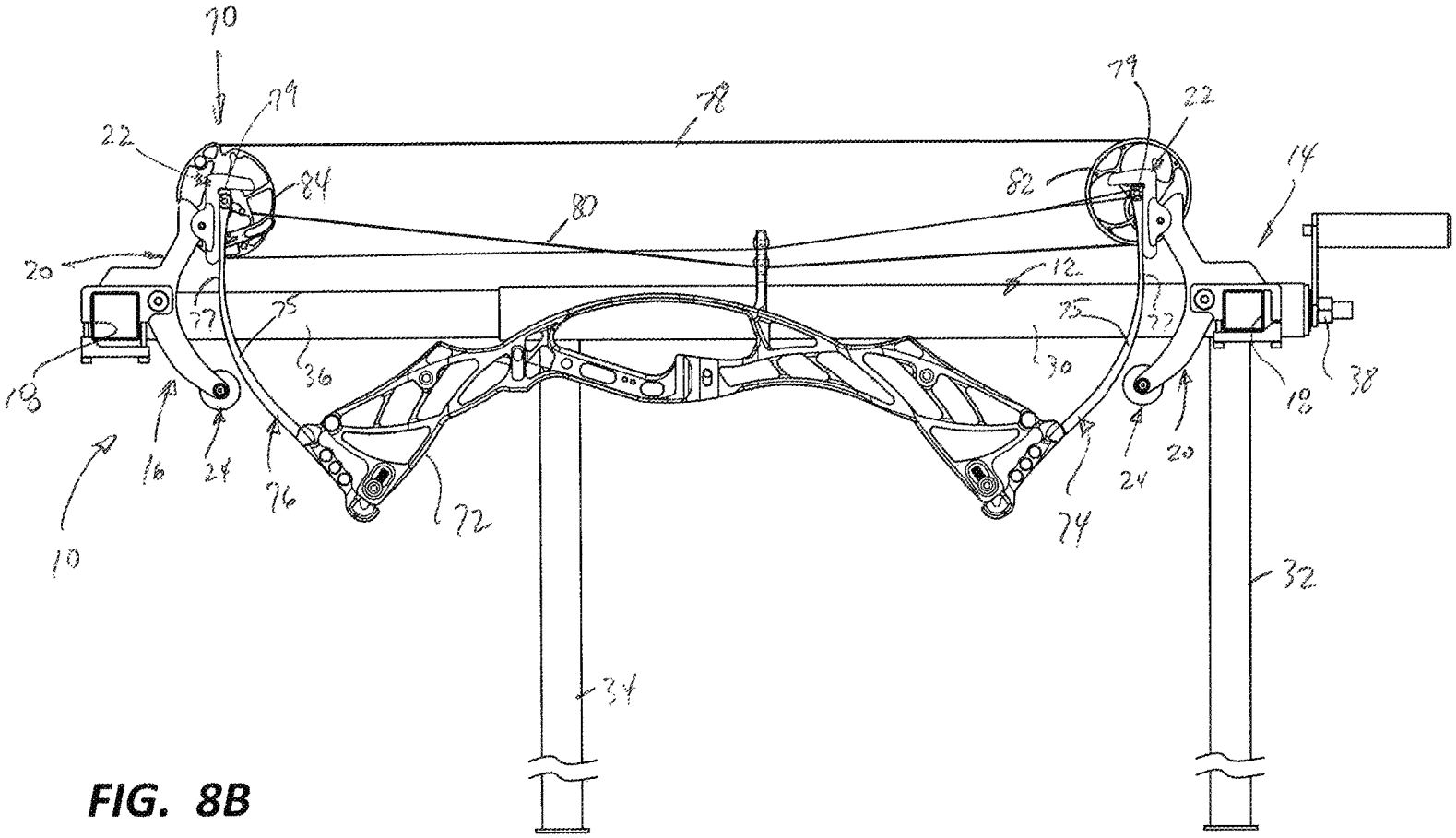

FIG. 8B shows the archery bow 70 in a first partially compressed state in which the distal ends of the limb 74, 76 are aligned substantially parallel with each other and aligned with a vertical direction. Further compressing the bow beyond what is shown in FIG. 8B moves the distal ends of the limbs 74, 76 further toward each other, which is a negative angle orientation relative to the vertical direction. The bow press 10 disclosed herein may be particularly effective when being used with archery bows having limbs that flex into negative angle orientations relative to the vertical direction when the archery bow is oriented in a vertical plane, as shown in FIGS. 8A-8D.

The contact member 24 is not yet in contact with the limbs 74, 76 in the compressed state shown in FIG. 8B. The archery bow 70 is maintained mounted to the bow press 10 in the flexed state shown in FIG. 8B only by contact between the second limb support 22 and the limb 74, 76. FIG. 9B shows the orientation of the distal end of the limb 74, 76 at an angle $\theta_2$ relative to the line $L_1$, which line represents the limb 74, 76 in the uncompressed state shown in FIG. 8A. FIG. 9B shows the force vectors $F_1$, $F_2$ and the resultant net force vector $V_2$ applied at the axle 56 for the compressed state of FIG. 8B.

Figure 8C:
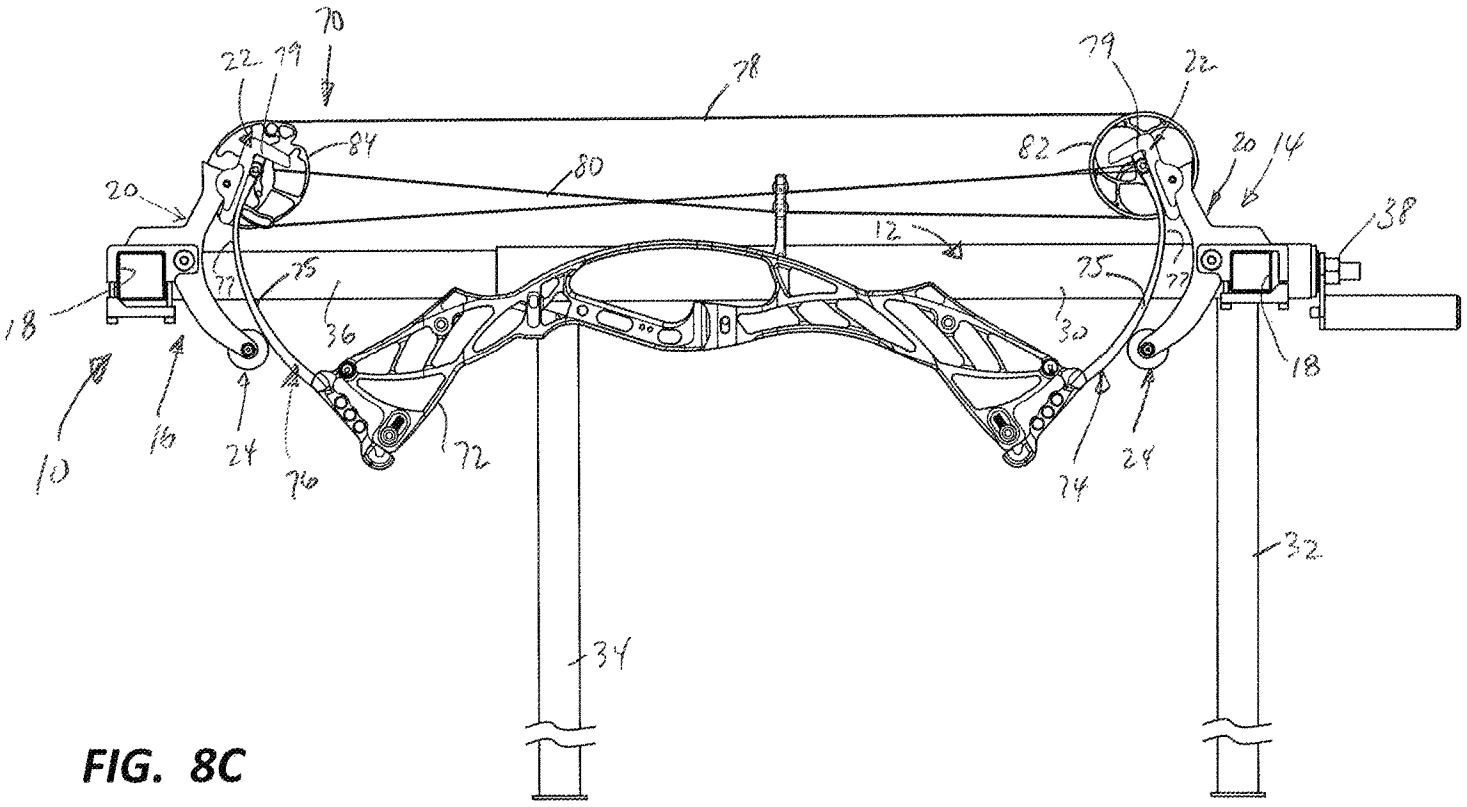

FIG. 8C shows a further compressed state for the archery bow 70 in which the distal ends of the limb 74, 76 have rotated past the vertical direction and into a negative angle $\theta_3$ orientation. With the arrangement shown in FIG. 8C, a net force vector $V_3$ may be directed horizontally or at least partially downward. The angle $\theta_3$ of the distal end of the limb as represented by line $L_3$ may determine at least in part the direction of the force vector $V_3$.

FIG. 8C also shows the contact member 24 in contact with the outer face 77 of the limb 74, 76. The contact member 24 contacts the limb 74, 76 at a location proximal of the bend area 75 of the limb 74, 76 (e.g., towards the riser 72). Compression forces applied by bow press 10 are passed through the contact member 24 to the limbs 74, 76 at this proximal location. The forces applied by contact member 24 include a set of force vectors $Z_1$, $Z_2$. A net force vector $Y_1$ shown in FIG. 9C may be directed at least partially vertically upward to apply an upward force that helps maintain contact between the limb 74, 76 and the second limb support 22. The vertically upward directed component of force vector $Y_1$ may counteract the vertically downward component of the net force vector $V_3$.

Figure 8D:
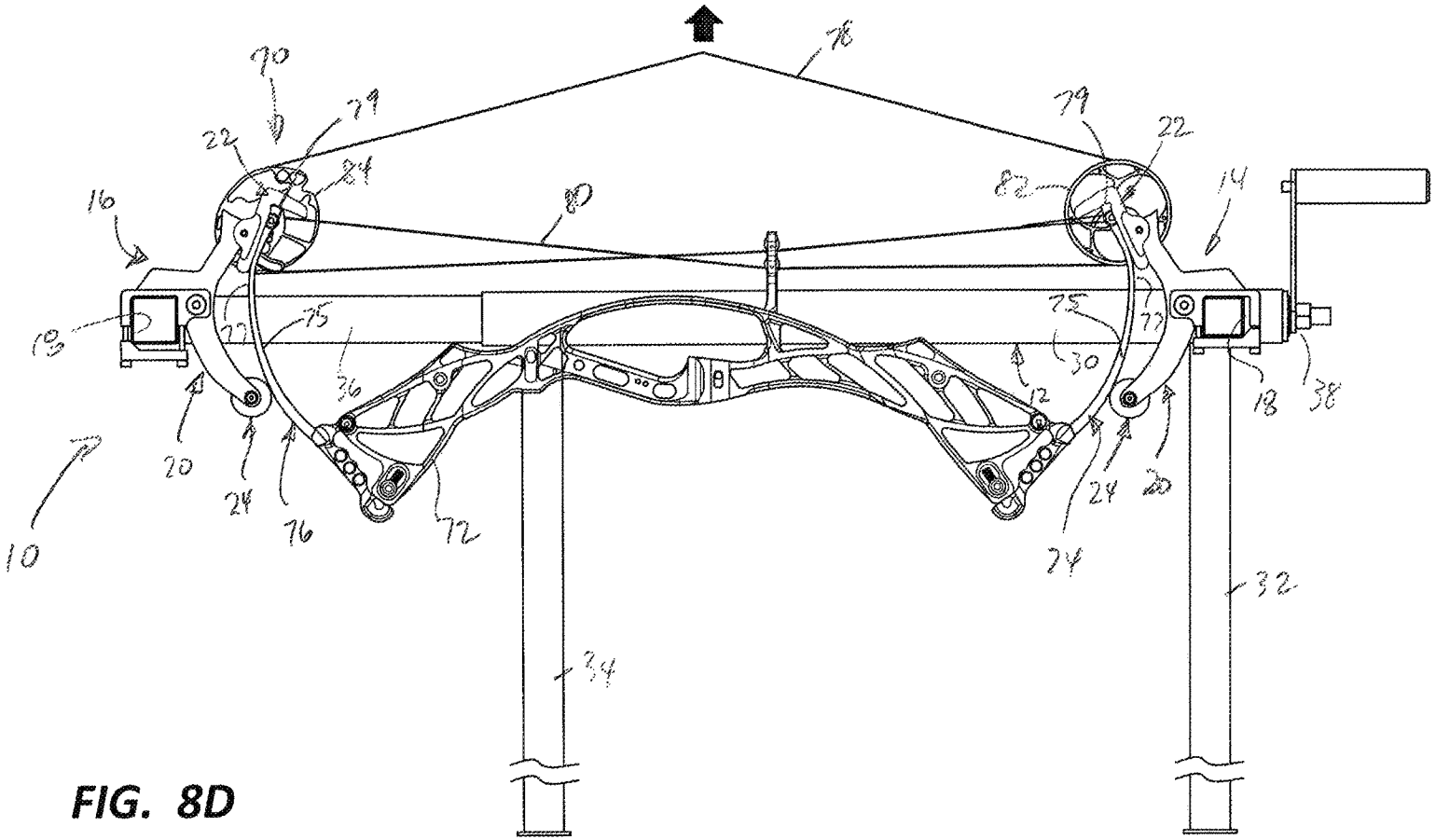
Figure 9D:
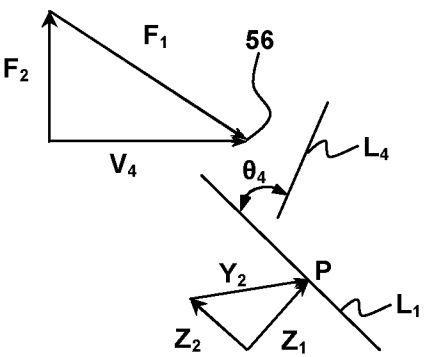
Figure 9C:
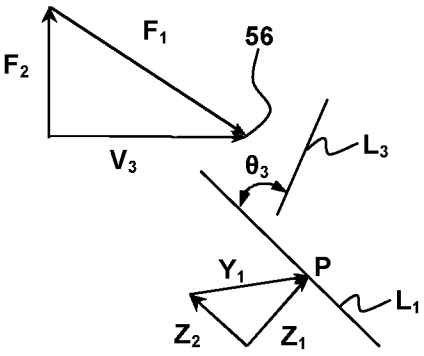

FIG. 8D shows the archery bow 70 in a compressed state in which the bowstring 78 and/or cables 80 may be released from the pulleys 82, 84 (e.g., referred to as a fully compressed state). The contact member 24 remains in contact with the limb 74, 76. As shown in FIG. 9D, the net force vector $Y_2$ may have an even greater vertical component than in the arrangement shown in FIG. 8C. FIG. 9D also shows an angle $\theta_4$ that is greater than $\theta_3$, and a net force vector $V_4$ that has a greater downward component as compared to the force vector $V_3$. The net force vector $V_4$ and $Y_2$ may counteract each other to help maintain connection of the archery bow 70 to the bow press 10.

The bow press 10 may provide improved safety while compressing an archery bow by increasing a holding force of the archery bow 70 within the bow press 10 as the archery bow 70 is loaded to a higher energy state (e.g., as the limbs are flexed or loaded). An example, method includes providing a contact point (e.g., via contact member 24) to the limbs 74, 76 that is below the flexed portion of limbs 74, 76 (e.g., below the bend area 75). This contact creates an upward directed force component that helps maintain contact between the limbs and the second limb support 22. This upward directed force may counteract the opposing downward directed force component that may be applied by the second limb support 22 to the distal end of the limb 74, 76 as the limbs 74, 76 are flexed beyond the vertical direction (e.g., parallel orientation to each other). By contrasting these vertical force components, and utilizing the added frictional force available by the interface between the second contact portions 54 of the second limb support 22 and the outer face of the limbs at the distal end of the limb, the archery bow 70 may be better able to remain in contact with the bow press 10 during maximum loading conditions. By contacting the limb 74, 76 at multiple locations along its length, one of which is positioned proximal of the bend section of the limb, the bow press 10, via the support assemblies 14, 16, may be better capable of avoiding unintentional release of the archery bow 70 from the bow press 10, particularly during maximum loaded conditions when pressing the bow 70.

The contact member 24 may include a low friction surface (e.g., rollers 60) that permits the contact member 24 to move along the limb 74, 76 as the limb 74, 76 is flexed while still applying the vertically upward force component that counteracts the vertically downward force component that may be applied by the second limb support 22.

The principles and teachings of the present disclosure are adaptable to many other types of archery bows besides compound archery bows, including, without limitation, crossbows, traditional bows, recurve bows, and related bow products. Additionally, while the bow press includes first and second support assemblies 14, 16 that interface with limbs 74, 76 of archery bow 70, it will be appreciated that in some embodiments the bow press includes only one or the other of the first and second support assemblies 14, 16 to interface with only one of the limbs 74, 76. Thus, the present disclosure is presented to provide examples of ways that principles and features of the bow press of the present disclosure may be implemented without limiting the disclosure to the exact configuration shown.

Various inventions have been described herein with reference to certain specific embodiments and examples. However, they will be recognized by those skilled in the art that many variations are possible without departing from the scope and spirit of the inventions disclosed herein, in that those inventions set forth in the claims below are intended to cover all variations and modifications of the inventions disclosed without departing from the spirit of the inventions. The terms "including:" and "having" come as used in the specification and claims shall have the same meaning as the term "comprising."

What is claimed is:

1. An archery bow press, comprising:

a base frame;

a first support assembly mounted to the base frame;

a second support assembly mounted to the base frame;

wherein each of the first and second support assemblies comprises a support member mounted to the base frame, a first limb support having first and second end portions and being mounted to the support member at a location spaced between the first and second end portions, and a second limb support pivotally mounted to the first end portion of the first limb support, the second limb support being configured to contact a distal end of a bow limb of an archery bow that is mounted to the archery bow press.

2. The archery bow press of claim 1, wherein the second limb support comprises:

a first portion configured to extend along and contact an outer face of the bow limb; and a second portion configured to extend along and contact a distal end surface of the bow limb.

3. The archery bow press of claim 2, further comprising a contact member mounted to the second end portion of the first limb support, the contact member being configured to contact the bow limb at a location spaced proximal of the distal end and proximal of a bend point in the bow limb when flexed, and wherein the second limb support pivots relative to the first limb support and the base frame to maintain contact with the outer face of the bow limb as the archery bow is compressed between the first and second support assemblies.

4. The archery bow press of claim 2, further comprising a contact member mounted to the second end portion of the first limb support, the contact member being configured to contact the bow limb at a location spaced proximal of the distal end and proximal of a bend point in the bow limb when flexed, and wherein the contact member comprises a roller that moves along the outer face of the bow limb as the archery bow is compressed.

5. The archery bow press of claim 1, wherein the base frame includes a horizontal member, at least two legs supporting the horizontal member, a telescoping member adjustably mounted to the horizontal member, and an actuator operable to move the telescoping member relative to the horizontal member.

6. The archery bow press of claim 5, wherein the first support assembly is mounted to the horizontal member and the second support assembly is mounted to the telescoping member, and operating the actuator moves the first and second support assemblies relative to each other to adjust a compression force applied to the archery bow.

7. The archery bow press of claim 1, further comprising a contact member mounted to the second end portion of the first limb support, the contact member being configured to contact the bow limb at a location spaced proximal of the distal end and proximal of a bend point in the bow limb when flexed.

8. The archery bow press of claim 1, wherein the first limb support maintains a fixed position relative to the support member.

9. The archery bow press of claim 1, wherein the second limb support includes a pair of second limb support members laterally spaced apart from each other a distance that accommodates a pulley of the archery bow.

10. The archery bow press of claim 1, wherein the first and second support assemblies are positioned laterally spaced apart from each other along a length of the base frame.

11. The archery bow press of claim 1, wherein the first limb support has a curved shape along its length.

12. The archery bow press of claim 1, wherein the second limb support has an L-shape construction.

13. A method of compressing an archery bow with a bow press, the method comprising:

providing a bow press having first and second bow support assemblies, each bow support assembly comprising first and second limb supports and a contact member, the second limb support being pivotally mounted to a first end portion of the first limb support, the contact member being mounted to a second end portion of the first limb support;

mounting the archery bow to the bow press with distal ends and outer faces of limbs of the archery bow being positioned in contact with the second limb supports;

moving the first and second bow support assemblies toward each other to apply a compression force to the archery bow to bend the limbs until the contact members contact the limbs, the contact members contacting the limbs at a location spaced proximal of the distal ends of the limbs and proximal of a bend region in the limbs when flexed; and wherein the second limb support rotates relative to the first limb support to maintain contact with the distal ends and outer faces of the limbs while the limbs are being flexed.

14. The method of claim 13, wherein contact between the contact members and the limbs provides application of a force component in a direction from the contact members toward the second limb supports.

15. The method of claim 14, wherein the force component contributes to maintaining the archery bow mounted to the bow press.

16. The method of claim 13, wherein the contact members move into and out of contact with the limbs as the compression force is applied to the archery bow.

17. The method of claim 13, wherein moving the first and second bow support assemblies toward each other includes moving the first and second bow support assemblies laterally relative to each other.

18. The method of claim 13, wherein moving the first and second bow support assemblies toward each other changes a direction of force vectors applied at an interface between the second limb supports and the limbs.

19. An archery bow press, comprising first and second support assemblies each comprising:

a first limb support having first and second end portions;

a second limb support pivotally mounted to the first end portion of the first limb support, the second limb support being configured to contact a distal end surface and an outer face of a bow limb of an archery bow that is mounted to the archery bow press, wherein the second limb support comprises a first portion configured to extend along and contact an outer face of the bow limb and a second portion configured to extend along and contact a distal end surface of the bow limb, wherein the second limb support pivots relative to the first limb support to maintain contact with the distal end surface and outer face of the bow limb as the archery bow is compressed between the first and second support assemblies; and a contact member mounted to the second end portion of the first limb support, the contact member being configured to contact the outer face of the bow limb at a location spaced proximal of the distal end surface and proximal of a bend section of the bow limb when flexed.

* * * * *